US006523515B2

(12) United States Patent
Kanao

(10) Patent No.: US 6,523,515 B2
(45) Date of Patent: Feb. 25, 2003

(54) SPARK PLUG FOR INTERNAL COMBUSTION ENGINES AND MANUFACTURING METHOD THEREOF

(75) Inventor: Keiji Kanao, Aichi-ken (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/822,472

(22) Filed: Apr. 2, 2001

(65) Prior Publication Data

US 2001/0025617 A1 Oct. 4, 2001

(30) Foreign Application Priority Data

Apr. 3, 2000 (JP) ..... 2000-105381
Jan. 18, 2001 (JP) ..... 2001-010679

(51) Int. Cl.[7] ..... H01T 13/39
(52) U.S. Cl. ..... 123/169 EL; 313/141; 445/7
(58) Field of Search ..... 123/169 R, 169 EL; 313/141; 445/7

(56) References Cited

U.S. PATENT DOCUMENTS 4,970,426 A * 11/1990 Bronchart ..... 313/141
5,210,457 A * 5/1993 Oshima et al. ..... 313/11.5
5,395,273 A * 3/1995 Matsutani ..... 219/121.64
5,461,276 A * 10/1995 Matsutani et al. ..... 313/141
5,551,902 A * 9/1996 Hubert et al. ..... 445/7
5,743,777 A * 4/1998 Demeuter ..... 313/11.5
5,866,973 A * 2/1999 Kagawa et al. ..... 313/141
6,093,071 A * 7/2000 Osamura et al. ..... 445/7
6,346,766 B1 * 2/2002 Kanao et al. ..... 313/141

FOREIGN PATENT DOCUMENTS

EP 0 518 707 A2 12/1992
JP 4-366581 12/1992

OTHER PUBLICATIONS

Patent Abstracts of Japanese Patent 05101869, vol. 017, No. 450, 1993.

* cited by examiner

*Primary Examiner*—Erick Solis
(74) *Attorney, Agent, or Firm*—Nixon & Vanderhye P.C.

(57) ABSTRACT

In a spark plug, an earth electrode (40) has a cladding member (43) made of a Ni-based alloy, a first core member (44) made of pure Cu and contained in the cladding member, and a second core member (45) made of pure Ni and contained in the first one. The second core member is protruded from the first one. A tip of the protruded portion is located to satisfy 0.3 mm≦L1≦L0, L1 being a distance between the protruded tip and a front end of the earth electrode and L0 being a distance between a farthest located edge of a melted portion (61 or 62) around a chip (60) from the front end of the earth electrode and the front end itself.

20 Claims, 9 Drawing Sheets

RATE OF PEELING : $\frac{D-d}{D} \times 100$

○ : NON-BUCKLED × : BUCKLED

| WELDING CURRENT (kA) | D \ L2 | L0−1 | L0 | L0+1 | L0+0.5 |
|---|---|---|---|---|---|
| 1.2 | 1.0 | ○ | ○ | ○ | |
| 1.4 | 1.5 | ○ | ○ | ○ | |
| 1.8 | 2.0 | ○ | ○ | ○ | |
| 2.0 | 2.2 | ○ | ○ | ○ | |
| 2.5 | 2.4 | × | × | ○ | ○ |

SPARK PLUG FOR INTERNAL COMBUSTION ENGINES AND MANUFACTURING METHOD THEREOF

BACKGROUND OF THE INVENTION

The present invention relates to a spark plug and a manufacturing method therefor, which spark plug is mounted on internal combustion engines, such as automobiles, cogeneration systems, gas-forcedly-feeding pumps, and in particular, to a spark plug equipped with an earth electrode on which a noble metal chip is welded at its tip end facing a center electrode of the spark plug and a manufacturing method for such a spark plug.

A spark plug of this kind is normally used in environments with severe thermal load. Temperature at its earth electrode is therefore easier to increase, frequently resulting in that the temperature exceeding a given temperature. To overcome this drawback, a countermeasure to decrease the temperature of the earth electrode is proposed. One countermeasure is that the earth electrode is embedded in a material having higher heat conductivity (for example, Cu or Ag), and the material is encapsulated into a cladding member made of metal having corrosion resistance and oxidation resistance (for example, a Ni-based alloy).

The greater amount of the good heat conductive material encapsulated in the cladding member, the higher an effect of decreasing the temperature of the earth electrode. Additionally, the electrode temperature becomes higher as being close to a front end of the earth electrode straight facing to the center electrode. Hence, to gain a large effect of decreasing the temperature, it is better to place a good heat conductive material at the tip of the earth electrode. However, if a good heat conductive material of which the melting point is low, such as Cu or Ag, is encapsulated and extended up to a root portion of a noble metal chip secured on the tip of the earth electrode, the material heats up and melts when the chip is welded onto the tip, thereby causing the earth electrode to deform due to buckling.

A Japanese Patent Laid-open publication NO.4-366581 discloses a structure to suppress deformation due to buckling occurring at the earth electrode when welding the chip. Practically, in the structure thus disclosed, a distance between a welded bottom surface of the chip and an end of the good heat conductive material is kept to 0 to 2 mm so that the material is avoided from being positioned immediately under the chip within the earth electrode.

However, the structure disclosed in the above publication sacrifices the temperature decreasing effect at a relatively large proportion, because the good heat conductive material is separated from being positioned immediately under the chip within the earth electrode.

SUMMARY OF THE INVENTION

Therefore, an object of the present invention is to provide a spark plug for internal combustion engines, which has an earth electrode, to a tip of which electrode facing to its center electrode a noble metal chip is welded, in which it is possible to not only prevent deformation due to buckling of the earth electrode when welding the noble metal chip but also securing an excellent effect of decreasing temperature at the earth electrode.

In order to realize the above object, one aspect of the present invention is provided by a spark plug for internal combustion engines, which is provided with an earth electrode (40) having a front end facing to a center electrode (30) of the spark plug, a noble metal chip (60) being welded to the front end via a melted portion (61 and 62) formed therebetween. The earth electrode (40) has a cladding member (43) made of metal having corrosion resistance and oxidation resistance, a first core member (44) not only made of metal higher in heat conductivity than the cladding member (43) but also contained in the cladding member, and a second core member (45) not only made of metal higher in melting point than the first core member (44) and superior in heat conductivity than the cladding member (43) but also contained in the first core member (44). The second core member (45) is protrudes, within the earth electrode (40), from a tip of the first core member (44) to a side of the front end of the earth electrode (40).

Further, a tip of a protruding portion of the second core member (45) is located at a position satisfying a distance L1 of not less than 0.3 mm and not more than a distance L0, the distance L1 being defined by a distance between the tip of the protruding portion of the second core member (45) and the front end of the earth electrode (40) and the distance L0 being defined by a distance between a farthest located edge of a melted portion (61 or 62) including the noble metal chip (60) from the front end of the earth electrode (40) and the front end of the earth electrode (40).

Conventionally, metal, such as Cu that is excellent in heat conductivity, it was hard to locate the metal under the chip. By contrast, the spark plug of the present invention adopts, as core members to gain heat conductivity, a configuration in which the first core member having a lower melting point is surrounded by the second core member having a higher melting point. Additionally, owing to the fact that the distance L1 is not more than the distance L0, the protruding portion of the second core member, which is protrudes from the first core member, can be located under the chip.

Further, the distance L1 is set to an amount of not less than 0.3 mm. If the distance L1 is less than 0.3 mm, the second core member is too close to the earth electrode. Thus, setting the distance L1 in that way prevents the second core member from being exposed from the cladding member when the spark plug is in operation.

According to the present invention, heat conductivity can be secured thanks to the first and second core members. In parallel, it is possible to employ, as the second core material, a material having a melting point that is high enough to be freed from deformations during welding of the chip. Hence, to prevent buckling of the earth electrode during an operation of welding the chip and to obtain an effect of decreasing temperature at the earth electrode are both relaxed.

In the foregoing spark plug, the metal constituting the cladding member (43) can be made of either a Ni alloy or a Fe alloy. The metal constituting the first core member (44) can be made of either Cu or a Cu alloy. Moreover, the metal constituting the second core member (45) can be made of a Ni alloy containing nickel of not less than 90 wt %, more preferably, pure Ni.

Still preferably, in the above construction, when taking a diameter of the noble metal chip (60) as D and taking a distance between the tip of the first core member (44) and the front end of the earth electrode (40) as L2, the tip of the first core member (44) is located in such a manner that the distance L2 is larger than the distance L0 in cases the diameter D is larger than 2.2 mm.

According to the present inventors' verification, it was found that whether or not buckling of the first core member located under the chip occurs depends on the diameter of the noble metal chip, because degrees of heating in welding the chip are changed. A further verification conducted by the present inventors revealed that determining a position of the tip of the first core member depending on the diameter D of the noble metal chip as described above led to more effective advantages than those obtained by the foregoing basic construction.

According to other aspect of the present invention, there can be provided methods for manufacturing spark plugs having the foregoing constructions in a secure manner.

The references enclosed in parentheses in the above constructions correspond to constituents detailed in the following embodiments, but it is not meant that those references limit the scope of the present invention.

PREFERRED EMBODIMENTS OF THE INVENTION

Referring to the accompanying drawings, preferred embodiments of the present invention will now be described.

[1] First Embodiment

Figure 1:
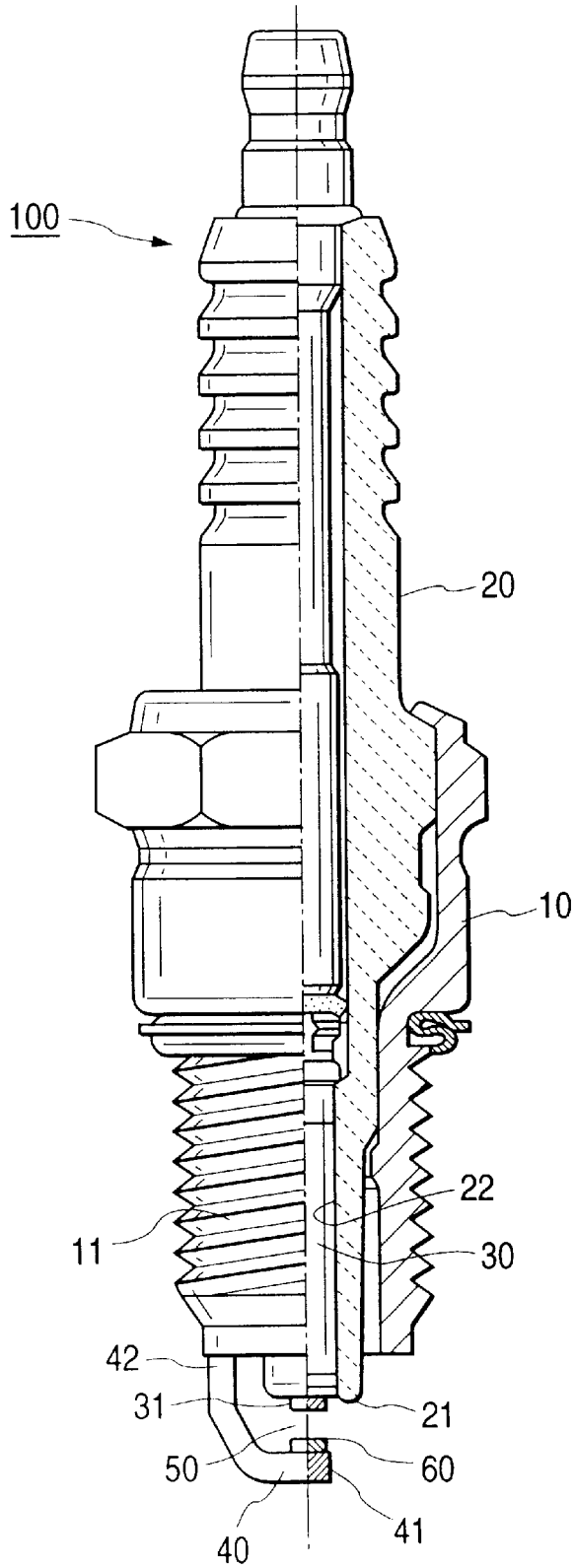
FIG. 1 is a schematic view, half in section, showing the entire construction of a spark plug according to a first embodiment of the present invention.

FIG. 1 is half a sectional view showing the entire construction of a spark plug 100 according to a first embodiment of the present invention. The spark plug 100, which is applied to a spark plug of an automobile engine, is inserted into a screw hole formed at an engine head partitioning combustion chambers of the engine and secured thereat.

The spark plug 100 has a substantially cylindrical fitting 10 made of conductive iron and steel material (for example, low carbon steel). On the fitting 10, a fitting screw part 11 is partly formed so that it is secured at an engine block not shown. A substantially cylindrical insulator 20 made of alumina ceramics ($Al_2O_3$) or others is inserted and secured in a bore of the fitting 10. The insulator 10 is disposed in the fitting 10 so that a tip 21 of the insulator 20 reaches out from the fitting 10.

The insulator 20 has an axial hole 22 formed therethrough, in which a center electrode 30 is inserted and fastened. The center electrode 30 is sustained in an insulated state against the fitting 10. The center electrode 30 is a cylindrical member made up of, for example, an inner member made of high heat-conductive metal such as Cu and an outer member made of metal of high heat resistance and corrosion resistance, such as a Ni-based alloy. As shown in FIG. 1, the center electrode 30 is disposed so that its tip 31 reaches out slightly from the tip 21 of the insulator 20.

On the other hand, the earth electrode 40 is formed into a prism member of which main component is a Ni-based alloy, for instance. A root end 42 of the earth electrode 40 is fastened to one end of the fitting 10 through welding, while a middle portion thereof is bent into an approximately L-shape, so that a front end 41 of the earth electrode 40 faces a front end 31 of the center electrode 30 so as to form a spark gap 50. At the front end 41 of the earth electrode 40, a noble metal chip 60 is welded to a surface of the front end 41, the surface facing the front end 31 of the center electrode 30.

Figure 2:
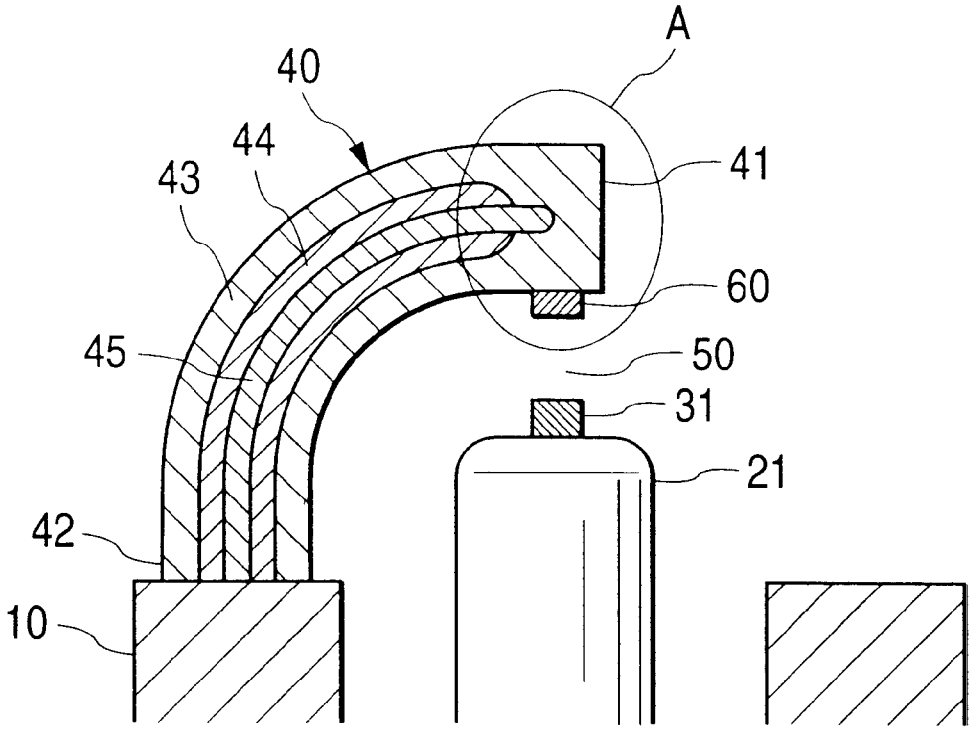
FIG. 2 is an enlarged sectional view of a vicinity of a spark gap of the spark plug shown in FIG. 1.
Figure 3A:
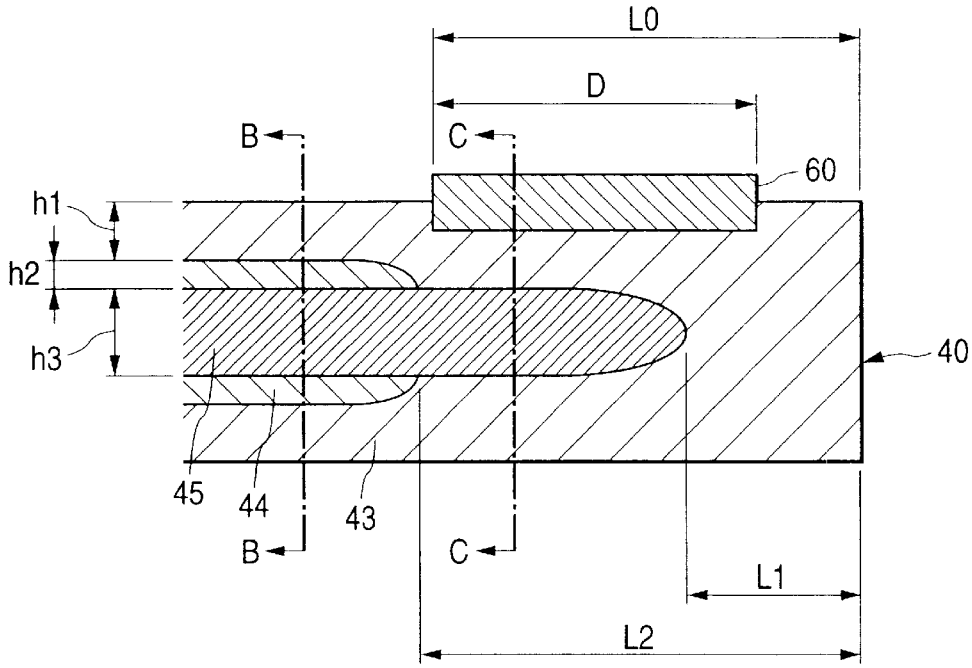
FIG. 3A is an enlarged view showing an A-portion in FIG. 2.
Figure 3B:
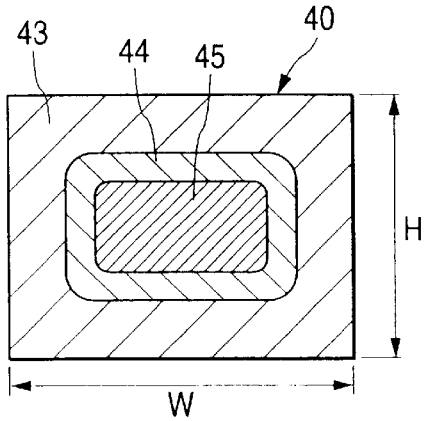
FIG. 3B is a sectional view sectioned along a B—B line in FIG. 3A.
Figure 3C:
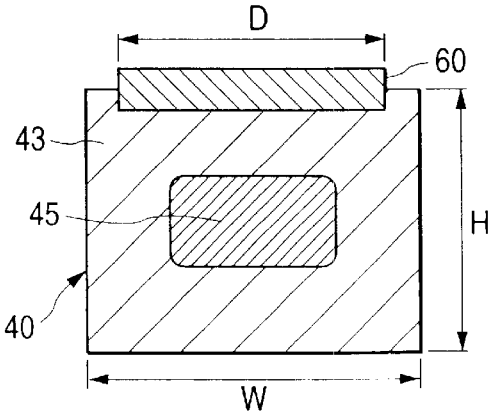
FIG. 3C is a sectional view sectioned along a C—C line in FIG. 3A.

FIG. 2 shows an enlarged sectional view in a vicinity of the spark gap 50 of the spark plug 100. FIGS. 3A to 3C detail the construction of FIG. 2, in which FIG. 3A is an enlarged view of an A-portion shown in FIG. 2, FIG. 3B is a sectional view along a B—B line in FIG. 3A, and FIG. 3C is a sectional view along a C—C line in FIG. 3A. The noble metal chip 60, which is formed into a circular plate made of metal such as Pt, Ir or an alloy thereof and of which diameter is D, is welded on the front end 41 of the earth electrode 40 by mean of resistance welding. The spark gap 50 is an air gap formed between the noble metal chip 60 and the front end 31 of the center electrode 30, and is about 1 mm, for example.

As shown in FIG. 2, the earth electrode 40 has, in principle, a three-layered construction. To be specific, the earth electrode 40 has a cladding member made of a first metal of which corrosion and oxidation resistance are high. Within an inner cavity of the cladding member 43, a first core member made of a second metal superior in heat conductivity than the cladding member 43 is contained. Further, within a bore of the first core member 44, a second core member 45 is contained which is made of a third metal superior in heat conductivity than the cladding member 43 and higher in melting point than the first core member 44 (the second metal).

Practically used materials for the above first to third metals are as follows. As the first metal, metal such as a Ni alloy or Fe alloy can be used, as the second metal, various types of metal including Cu, a Cu alloy, Ag, or an Ag alloy can be used, and as the third metal, metal such as a Ni alloy containing Ni not less than 90 wt % can be used.

As shown in FIGS. 3A to 3C, within the earth electrode 40, the second core member 45 protrudes from a tip of the first core member 44 toward the side of the front end of the earth electrode 40. Thus, dimensions can be set in FIG. 3A such that L1 is taken as a distance between a tip of the protruding portion of the second core member 45 and the front end of the earth electrode 40, L0 is taken as a distance between the farthest located edge of the noble metal chip 60 from the front end of the earth electrode 40 and the front end of the earth electrode 40, and L2 is taken as a distance between the tip of the first core member 44 and the front end of the earth electrode 40.

Figure 4A:
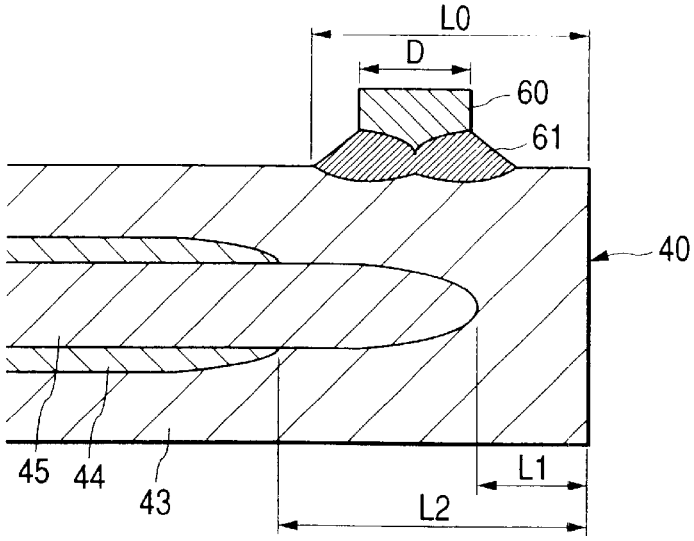
FIG. 4A shows a schematic sectional view illustrating a connected state between a noble metal chip and an earth electrode on the basis of a melted portion formed by means of laser welding.

Securing the noble metal chip 60 to a surface of the front end 41 of the earth electrode 40 which is faced to the front end of the center electrode 30 can be realized by means of laser welding or resistance welding. In some cases, this welding causes the noble metal chip 60 and the earth electrode 40 to melt to form a melted portion connecting the noble metal chip 60 and the earth electrode 40 to each other. FIG. 4A illustrates such a state appearing in the laser welding, while FIG. 4B does such a state appearing in the resistance welding.

Figure 4B:
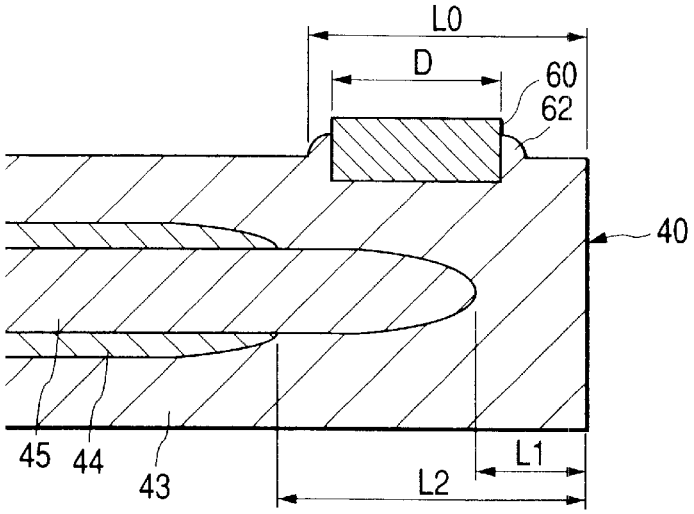
FIG. 4B shows a schematic sectional view illustrating a connected state between a noble metal chip and an earth electrode on the basis of a melted portion formed by means of resistance welding.

In the case of the laser welding, the welding causes the noble metal chip 60 and earth electrode 40 to melt together to form a melted portion 61, while in the case of the resistance welding, the welding causes the noble metal chip 60 to swell at its surrounding region to form a melted portion 62. Therefore, in such a case, as shown in FIG. 4A or 4B, the foregoing distance L0 is expressed as a distance between the farthest located edge of a region of the melted portion 61 or 62, including the noble metal chip 60, from the front end of the earth electrode 40 and the front end of the earth electrode 40.

In the present embodiment, a tip of a protruding portion of the second core member 45 is positioned so that a relationship of 0.3 mm$\leqq$L1$\leqq$L0 is realized. The reason why such a positional relationship is determined will now be described. The second core member 45 (pure Ni) has an approximately equal melting point to that of the cladding member (a Ni-based alloy) 43, and it is considered that heat generated when the chip 60 is welded has no influence on the second core member 45. Hence, taking heat drawing into account, the distance L1 should be smaller.

However, if the distance L1 is set to an extremely small amount, the second core member 45 is too closely located to the front end of the earth electrode 40. As a result, it is easier for the second core member 45 to be exposed from the cladding member 43 during use of the spark plug. For instance, when an engine test that corresponds to a real-car running distance of 100,000 km, which satisfies practical uses, the cladding member 43 wears down by an amount of approximately 0.3 mm. Thus, with the corrosion and oxidation resistance of the cladding member 43 taken into consideration, the distance L1 is determined to an amount not less than 0.3 mm.

The relation of L1$\leqq$L0 is based on a verified result of an effect of decreasing temperature, which is conducted by the inventors with the distance L1 changed to various amounts. The verified result will now be exemplified, though the present embodiment is not meant to be limited to it. In this verification, a heat-cool cycle test of an engine was conducted to examine a rate of peeling of the chip 60 against the number of cycles at each of a variety of amounts of the distance L1.

Figure 5:
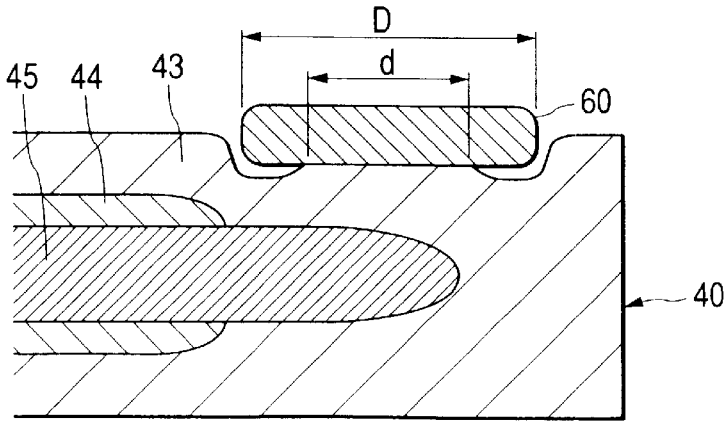
FIG. 5 shows a schematic sectional view representing the tip of the earth electrode.

A condition for the engine in this verification was set such that one cycle consisting of a one-minute idling state of the engine (at about 300° C., for example) and another one-minute full throttle state of 6000 rpm thereof (at about 900° C., for example) was repeated. When, as shown in FIG. 5, viewed in the axial direction of the earth electrode 40, D is a diameter of the noble metal chip 60, d is a diameter of a non-peeled part thereof, and a length of a remaining peeled part thereof is D−d, the rate of peeling was evaluated by an amount of 100(D−d)/D (%), which is figured out by multiplying by 100 a ratio (D−d)/D between the length D−d of the peeled part and the diameter D of the noble metal chip 60.

Additionally, characteristics of material of the constituents used for this verification are as follows. Used as the cladding member (the first metal) is a Ni-based alloy (known as Inconel (registered trademark)) of which heat conductivity $\alpha$ is 10 W/m·K and melting point Tm is 1380° C., used as the first core member 44 (the second metal) is pure Cu of which heat conductivity $\alpha$ is 391 W/m·K and melting point Tm is 1083° C., used as the second core member 45 (the third metal) is pure Ni of which heat conductivity $\alpha$ is 89 W/m·K and melting point Tm is 1453° C. Further, a Pt-made chip is used as the noble metal chip 60.

The dimensions of the constituents used for this verification are as follows (refer to FIGS. 3A to 3C). A section of the earth electrode 40 was shaped into 2.8 m in width W and 1.6 mm in thickness H. At the three-layered construction, a thickness h1 of the cladding member 43 was 0.3 mm, a thickness h2 of the first core member 44 was 0.2 mm, and a thickness h3 of the second core member 45 was 0.6 mm. Moreover, a diameter D of the chip 60 was 1.0 mm, in addition to the foregoing distance L0 being set to 2 mm and distance L2 to 4 mm.

Figure 6:
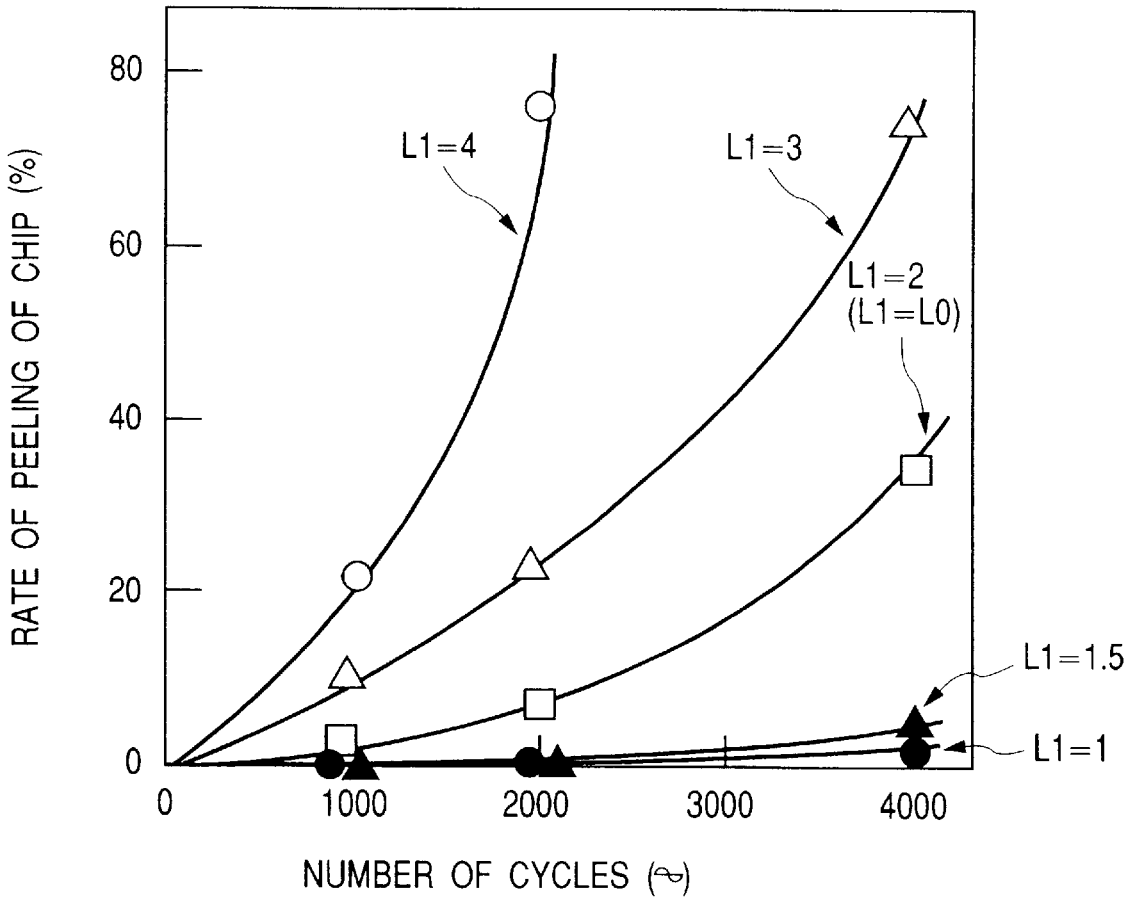
FIG. 6 is a graph representing a relationship between the number of heat-cool cycles and the rate of peeling observed when taking a distance L1, shown in FIG. 4A or 4B, as a parameter.

Based on such materials and dimensions of the constituents, the above-stated heat-cool cycle test was performed to obtain the rate of peeling (%) of the chip 60 against the number of cycles with the distance L1 changed into different lengths (1, 1.5, 2, 3, 4 mm). The obtained rate of peeling is shown by the graph of FIG. 6. This graph reveals that, as the rate of peeling "100(D−d)/D" becomes smaller, the temperature at the earth electrode 40 lowers, thus thermal stress being relaxed.

As shown in FIG. 6, the smaller the distance L1, the less the peeling of the chip 60. In cases the distance L1 is less than the distance L0 (2 mm), the peeling is suppressed to such a degree that the peeling can be disregarded for practical uses. It is considered that this suppression of the peeling is due to the fact that the presence of the second core member 45 as a good heat conductive material under the chip 60 within the earth electrode 40 helps the temperature around the chip 60 to lower, relaxing heat stress. Based on the consideration that has been made so far, the tip of protruding portion of the second core member 45 is located at a position satisfying 0.3 mm≦L1≦L0.

Additionally, in the present embodiment, it is preferred that the tip of the protruding portion of the second core member 45 is located so as to fulfill a condition of L2>L0 when the diameter D of the noble metal chip 60 is D>2.2 mm. This condition is based on a result verified about the distance L2 in order to avoid the first core member 44 from being influenced by heat during the welding, because the first core member 44 has a relatively lower melting point. A verified result will now be exemplified, though the present embodiment is not meant to be limited to it.

For verifying a preferable range of the distance L2, the noble metal chip 60 was welded to the earth electrode 40 by means of resistance welding, in which welding current for the resistance welding was necessarily changed depending on the diameter D of the chip 60. Thus a degree of heating was also changed depending on the diameter D of the chip 60. Therefore, verification was conducted for the range of the distance L2 capable of preventing buckling (deformations of the first core member 44) in cases both of the diameter D of the chip 60 and the welding current are changed to various amounts. The diameter D of the chip 60 was changed in the range of ϕ=1.0 to 2.4 mm and the thickness thereof was 0.3 mm. Further, the materials and dimensions of W, H, h1 to h3, and L0 of the constituents used in this verification were the same as those used in the foregoing verification with respect to the distance L1.

Figures 7, 8:
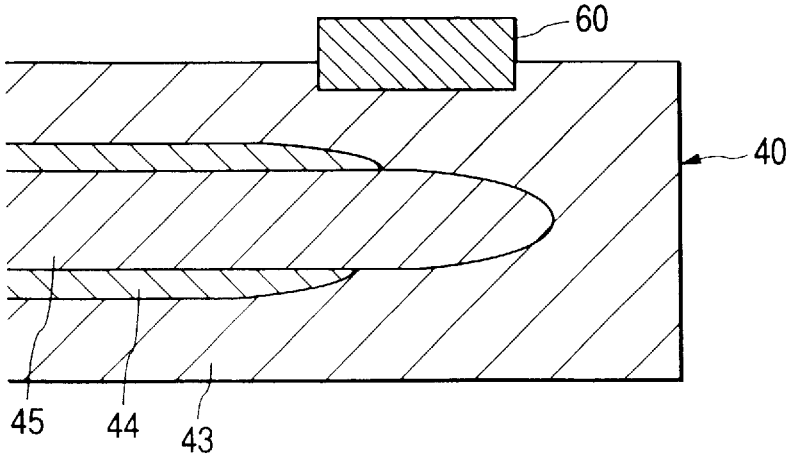
FIG. 7 is an illustration showing a consideration result with respect to a relationship between a diameter of the noble metal chip and a distance L2 shown in FIG. 4A or 4B.
FIG. 8 is a schematic sectional view exemplifying a configuration of the noble metal chip where a first core member is located immediately under the chip in the case that the diameter of the chip is not less than 2.2 mm.

FIG. 7 shows whether buckling was caused or not under various amounts of the distance L2 changed in relation to the distance L0 where the diameter D of the chip 60 and the welding current were individually specified. In experiment shown in FIG. 7, a welding pressure applied in the resistance welding was set to 250 N, the number of cycles was set to a constant value of 10, and a welding current was set to 1.2, 1.4, 1.8, 2.0 and 2.5 kA when the diameter D was set to 1.0, 1.5, 2.0, 2.2 and 2.4 mm, respectively.

The resistance welding was performed with three configurations. A first configuration is that the distance L2 is less than L0 by 1 mm so that the tip of the first core member (pure Cu) 44 is located immediately under the chip 60 (i.e., L0−1), a second one is that the distance L2 equals to L0, and a third one is that the distance L2 is larger than L0 by 1 mm so that the tip of the first core member (pure Cu) 44 is not located immediately under the chip 60 (i.e., L0+1). For those three configurations, whether buckling was caused or not is shown in FIG. 7, where non-buckling is marked by a circle, while buckling caused is marked by a cross. Additionally, in the case of the diameter D=2.4 mm, a result of a configuration in which the distance L2 is larger than L0 by 0.5 mm (i.e., L0+0.5).

As understood from FIG. 7, where a condition of D≦2.2 mm is met, the distance can be even less than L0 (L2<L0). That is, the first core member (pure Cu) 44 is located even immediately under the chip 60 as shown in FIG. 8, the buckling will not be caused, because the welding current is still small in amount. By contrast, when a condition D>2.2 mm is met, the distance L2 falls in the L2>L0 range. In other words, the tip of the first core member 44 should step back so as not to be located immediately under the chip 60, otherwise buckling will be caused due to large amounts of welding current.

Additionally, the first core member 44 such as pure Cu is excellent in heat conductivity, but lower in melting point. Hence, depending on such a degree that the first core member 44 extends to the front end of the earth electrode 40, diffusion of the first core member 44 into the neighboring metal (such as a Ni alloy) advances in use to form an alloy layer with the neighboring one. Since such an alloy layer causes heat conductivity to be greatly deteriorated, it is preferable that the first core member 44 not be located immediately under the chip 60 and only the second core material 45 be located thereunder. When considering both of this result and the foregoing result for the distance L2, it is most preferable that the relation of L2>L0 be maintained for D>2.2 mm.

Referring to FIGS. 9A to 9G, a manufacturing method for the earth electrode 40 of the spark plug 100 constructed as above will now be described. The remaining constituents other than the earth electrode 40 are manufactured in the same manners as those known, which are therefore omitted in this description. FIGS. 9A to 9G show schematic sectional views of the manufacturing steps of the earth electrode 40.

Processing such as cold forging is first performed with each of the foregoing first to third metals. By this processing, prepared are a first cup-like element 200 made of the first metal (refer to FIG. 9A), a second cup-like element 201 made of the second metal (refer to FIG. 9B), and a core member 202 made of the third metal and formed into a rod-like member having a diameter-increased head portion 202*a* at one end thereof, the portion 202*a* being larger than the other end in diameter.

For example, the first cup-like element 200 can be formed into a cylindrical cup shape, made of Inconel (registered trademark), of which its outer diameter g1 is ϕ3.5 mm and its length g2 is 10 mm and which has an opening whose inner diameter g3 is ϕ2.2 mm and its depth g4=6 mm. The second cup-like element 201 can be formed into a cylindrical cup shape, made of pure Cu, of which outer diameter g5 is ϕ2.15 mm and its length g6=6 mm and which has an opening of which inner diameter g7 is ϕ1.4 mm and its depth g8 is 5.5 mm. Further, the core member 202 can be formed into a rivet shape, made of pure Ni, which has a diameter-increased head portion of which diameter g9 is ϕ2.15 mm and its length g10 is 0.5 mm and which has a smaller-diameter rod portion whose diameter g11 is ϕ1.4 mm and its entire length g12 is 6 mm.

The core member 202 is then inserted, with its rod portion ahead, into the second cup-like element 201. This enables the core member 202 and second cup-like element 201 to unite to form a complex 203, with the diameter-increased head portion 202*a* exposed from the second cup-like element 201 (refer to FIG. 9D).

The complex 203 is then inserted, with its diameter-increased head portion 202*a* ahead, into the first cup-like element 200. This permits the complex 203 and the first cup-like element 200 to unite to form a member (united member) 204, with the diameter-increased head portion 202*a* located at a bottom of opening of the first cup-like element 200 (refer to FIG. 9E).

Figure 9A:
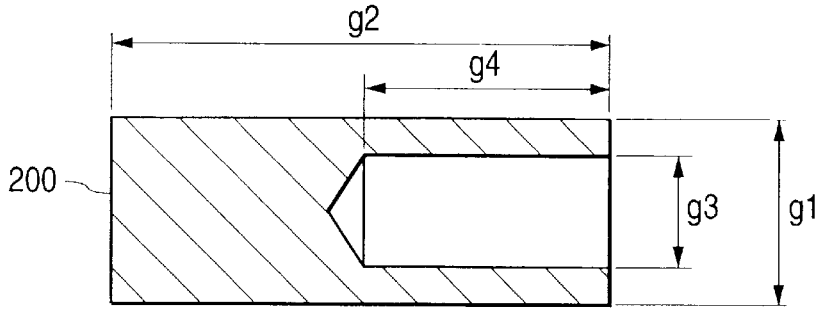
FIGS. 9A to 9G show a series of assembling steps of the earth electrode according to the first embodiment.
Figure 9B:
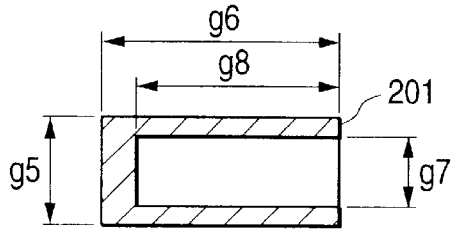
Figure 9C:
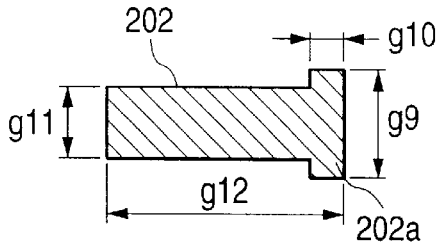
Figure 9D:
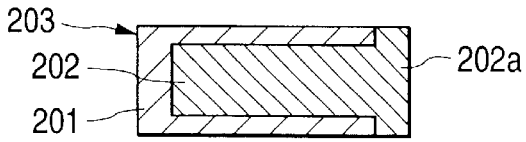
Figure 9E:
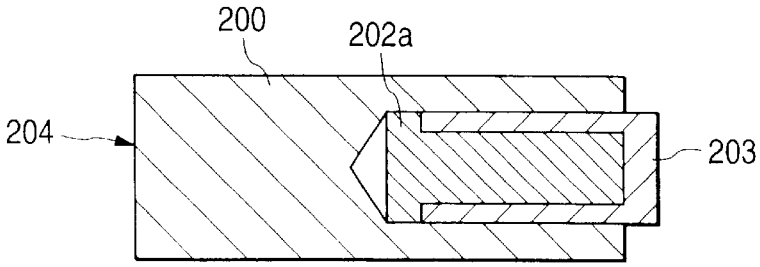
Figure 9F:
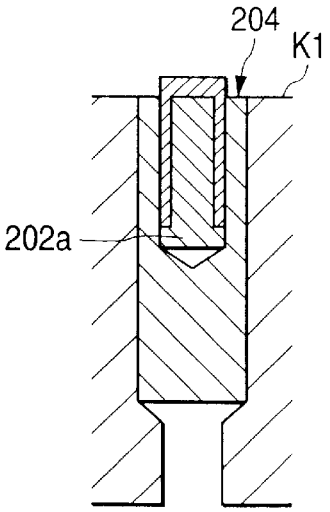
Figure 9G:
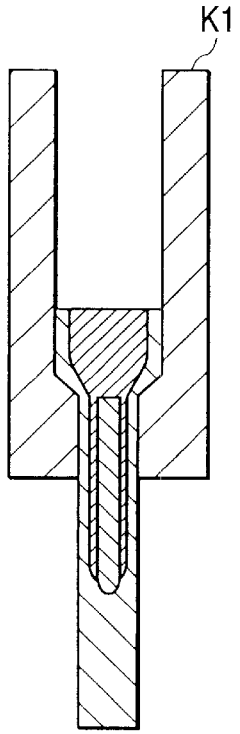

Succeedingly, as shown in FIGS. 9F and 9G, extruding the united member 204 through a mold K1, with a bottom side of the first cup-like element 200 ahead, causes the united member to be formed into a shape of the earth electrode 40 (prism shape). By way of example, as in the foregoing example, a prism shape of which width W is 2.8 mm and its thickness H is 1.6 mm can be produced. This extruding allows the complex 203 residing within the first cup-like element 200 to be altered into a shape having the front end 41 of the earth electrode 40 shown in FIGS. 2 and 3A to 3C.

The earth electrode 40 is then fastened to the fitting 10 by welding, before the noble metal chip 60 is resistance-welded to the front end 41 of the earth electrode 40. The earth electrode 40 is bent to form the spark gap 50 between the chip 60 and the front end 31 of the center electrode 60. Through the foregoing steps, the spark plug 100 is manufactured.

According to the present embodiment, the condition of 0.3 mm≦L1≦L0 is satisfied, thus making it possible to locate, immediately under the noble metal chip 60, the second core member 45 of which melting point is relatively higher protruding from the first core member of which melting point is reactively lower, within the earth electrode 40. Therefore, heat conductivity can be secured by the first and second core members 44 and 45 each of which heat conductivity are superior. Concurrently, because the second core member 45 of which melting point is higher does not deform during a welding operation of the chip 60, both preventing the earth electrode 40 from being deformed due to buckling and decreasing the temperature at the earth electrode 40 can be realized during an operation of welding the chip.

According to a preferred example of the present embodiment, the condition of L2>L0 is set for D>2.2 mm. This avoids not only buckling resulting from first core member 44 but also heat conductivity from decreasing on account of an alloy layer formed with the first core member 44. This provides particular advantages for setting L2>L0.

[2]Second Embodiment

A second embodiment of the present invention will now be described, which is related to a method for manufacturing an earth electrode 40 different from that of the first embodiment. Hereinafter, described is only differences from the first embodiment. FIGS. 10A to 10E show schematic sectional views illustrating the manufacturing method in the second embodiment, wherein the same or identical constituents as or to those in the foregoing first embodiment are represented by the same references.

First, prepared are a cup-like element 200 made of the first metal, as a similar element to the first cup-like element 200 in the first embodiment, a rod-like element 300 made by cladding the third metal with the second metal (refer to FIG. 10A), and a disk-like element 301 made of the third metal 301 (refer to FIG. 11B). The rod-like element 300 can be formed into a united member by, for example, inserting a rod 302 made of the third metal into a tube 303 made of the second metal, and then extruding the tube 303.

The cup-like element 200 can be formed with, for instance, the similar materials and dimensions to that used in the first embodiment. The rod-like element 300 can be formed into a prism-shape element in which the rod 302 made of pure Ni and the tube 303 made of pure Cu are united. Example of the tube 303 are that its inner diameter f1 is ϕ2.15 mm, its length f2 is 6 mm, and its wall thickness f3 is 0.4 mm. The disk-like element 301 can be made of pure Ni and formed to have a diameter f4 of ϕ2.15 mm and a thickness f5 of 0.5 mm.

The disk-like element 301 is first disposed at a bottom of the cup-like element 200, and then the rod-like element 300 is inserted into the opening of the cup-like element 200. This is able to form a member 304 (united member) in which the disk-like element 301 is sandwiched between an inserted-side end of the rod-like element 300 and the bottom of opening of the cup-like element 200 (refer to FIG. 10C).

Figure 10A:
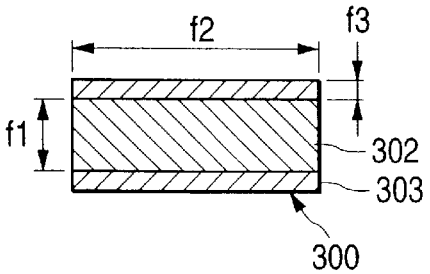
FIGS. 10A to 10E show a series of assembling steps of the earth electrode according to a second embodiment of the present invention.
Figure 10B:
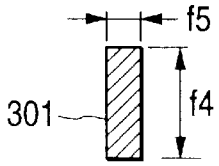
Figure 10C:
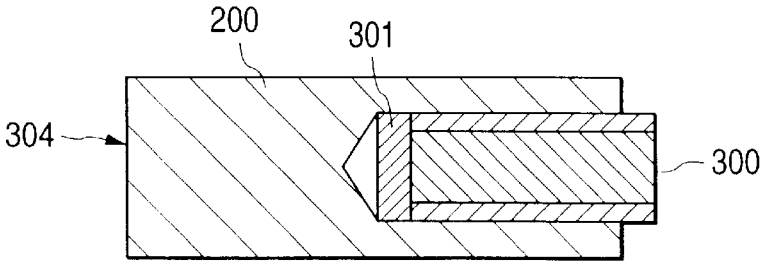
Figure 10D:
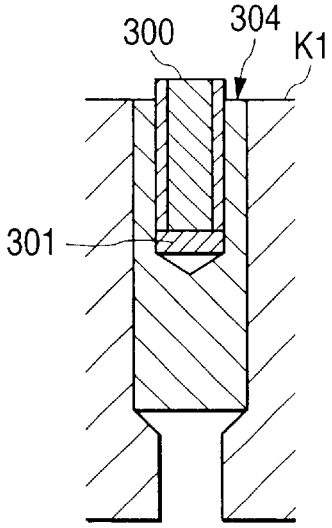
Figure 10E:
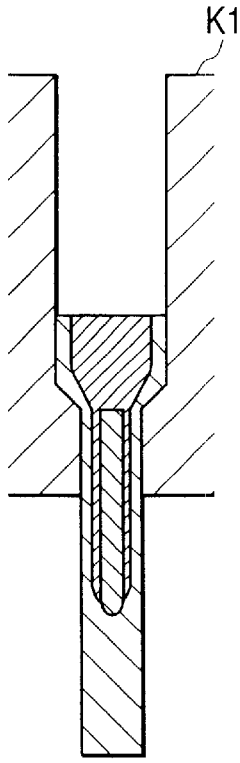

Like the foregoing first embodiment, the united member 304 is extruded with the bottom side of opening of the cup-like element 200 advancing ahead, resulting in that the united member 304 is shaped into the earth electrode 40 (refer to FIGS. 10D and 10E). During an extruding operation, the rod-like element 301 and disk-like element 302 both disposed in the cup-like element 200 are elongated in their shapes, so that an inner shape of the front end 41 of the earth electrode 40 is altered into that shown in FIGS. 2 and 3.

Then, securing the earth electrode 40 to the fitting 10, welding the chip 60, forming the spark gap 50 and others are performed in turn, thereby providing the spark plug 100. Therefore, the manufacturing method of the second embodiment makes it possible to manufacture the spark plug 100 in a proper manner, like the first embodiment.

[3] Modification

Figure 11:
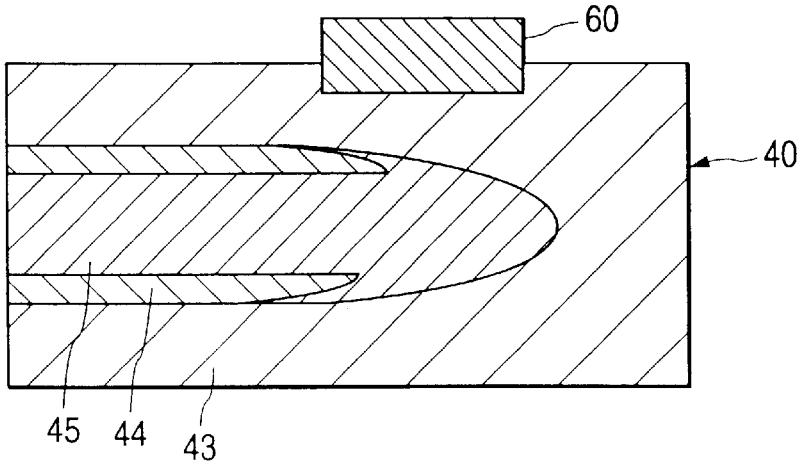
FIG. 11 is a schematic sectional view exemplifying another configuration in which a second core member is protruded from a tip of a first core member.

In the construction of FIG. 3, the second core member 45 is protruded, within the earth electrode 40, from the tip of the first core member 44 to the front end side of the earth electrode 40, but a protruded portion of the second core member 45 remains within a radial-directional range limited by an inner diameter of the first core member 44. Alternatively, as shown in FIG. 11, the second core member 45 may protrude such that its protruding portion is enlarged in diameter so as to be crowned on the entire tip of the first core member 44. The shapes of such protruding portions are changed dependently on conditions such as an extruding process of the foregoing united member 204 or 304.

As has been described, the main feature of the embodiments is to not merely insert a good conductive member deeply toward the front end of the earth electrode in order to gain a great effect of decreasing temperature at the earth electrode but also limit the material type and a located position of the good conductive material in order to prevent the earth electrode from deforming due to buckling during an operation welding a chip to the front end of the earth electrode. Such configurations enable spark plugs to have a remarkable improvement in heat resistance and to be endurable even if they are used in severe heat-stress environments.

Although the description above contains many specificities, these should not be construed as limiting the scope of the invention but as merely providing illustrations of some of the presently preferred embodiments of the present invention. Thus the scope of the present invention should be determined by the appended claims and their equivalents.

I claim:

1. A spark plug for internal combustion engines, which is provided with an earth electrode having a front end facing to a center electrode (30) of the spark plug, a noble metal chip being welded to the front end via a melted portion formed therebetween, wherein the earth electrode has a cladding member made of metal having corrosion resistance and oxidation resistance, a first core member not only made of metal higher in heat conductivity than the cladding member but also contained in the cladding member, and a second core member not only made of metal higher in melting point than the first core member and superior in heat conductivity as compared to the cladding member but also contained in the first core member (44), the second core member protruding, within the earth electrode, from a tip of the first core member to a side of the front end of the earth electrode; and a tip of a protruding portion of the second core member being located at a position satisfying a distance L1 of not less than 0.3 mm and not more than a distance L0, the distance L1 being defined by a distance between the tip of the protruding portion of the second core member and the front end of the earth electrode and the distance L0 being defined by a distance between a farthest located edge of the melted portion including the noble metal chip from the front end of the earth electrode and the front end of the earth electrode.

2. A spark plug for internal combustion engines of claim 1, wherein the metal constituting the cladding member (43) is either a Ni alloy and a Fe alloy.

3. A spark plug for internal combustion engines of claim 2, wherein, when taking a diameter of the noble metal chip (60) as D and taking a distance between the tip of the first core member (44) and the front end of the earth electrode (40) as L2, the tip of the first core member (44) is located in such a manner that the distance L2 is larger than the distance L0 in cases the diameter D is larger than 2.2 mm.

4. A spark plug for internal combustion engines of claim 2, wherein the metal constituting the first core member (44) is either Cu and a Cu alloy.

5. A spark plug for internal combustion engines of claim 4, wherein, when taking a diameter of the noble metal chip (60) as D and taking a distance between the tip of the first core member (44) and the front end of the earth electrode (40) as L2, the tip of the first core member (44) is located in such a manner that the distance L2 is larger than the distance L0 in cases the diameter D is larger than 2.2 mm.

6. A spark plug for internal combustion engines of claim 4, wherein the metal constituting the second core member (45) is a Ni alloy containing nickel of not less than 90 wt %.

7. A spark plug for internal combustion engines of claim 6, wherein, when taking a diameter of the noble metal chip (60) as D and taking a distance between the tip of the first core member (44) and the front end of the earth electrode (40) as L2, the tip of the first core member (44) is located in such a manner that the distance L2 is larger than the distance L0 in cases the diameter D is larger than 2.2 mm.

8. A spark plug for internal combustion engines of claim 2, wherein the metal constituting the second core member (45) is a Ni alloy containing nickel of not less than 90 wt %.

9. A spark plug for internal combustion engines of claim 8, wherein, when taking a diameter of the noble metal chip (60) as D and taking a distance between the tip of the first core member (44) and the front end of the earth electrode (40) as L2, the tip of the first core member (44) is located in such a manner that the distance L2 is larger than the distance L0 in cases the diameter D is larger than 2.2 mm.

10. A spark plug for internal combustion engines of claim 1, wherein the metal constituting the first core member (44) is either Cu and a Cu alloy.

11. A spark plug for internal combustion engines of claim 10, wherein, when taking a diameter of the noble metal chip (60) as D and taking a distance between the tip of the first core member (44) and the front end of the earth electrode (40) as L2, the tip of the first core member (44) is located in such a manner that the distance L2 is larger than the distance L0 in cases the diameter D is larger than 2.2 mm.

12. A spark plug for internal combustion engines of claim 10, wherein the metal constituting the second core member (45) is a Ni alloy containing nickel of not less than 90 wt %.

13. A spark plug for internal combustion engines of claim 12, wherein, when taking a diameter of the noble metal chip (60) as D and taking a distance between the tip of the first core member (44) and the front end of the earth electrode (40) as L2, the tip of the first core member (44) is located in such a manner that the distance L2 is larger than the distance L0 in cases the diameter D is larger than 2.2 mm.

14. A spark plug for internal combustion engines of claim 1, wherein the metal constituting the second core member (45) is a Ni alloy containing nickel of not less than 90 wt %.

15. A spark plug for internal combustion engines of claim 14, wherein, when taking a diameter of the noble metal chip (60) as D and taking a distance between the tip of the first core member (44) and the front end of the earth electrode (40) as L2, the tip of the first core member (44) is located in such a manner that the distance L2 is larger than the distance L0 in cases the diameter D is larger than 2.2 mm.

16. A spark plug for internal combustion engines of claim 14, wherein the metal constituting the second core member (45) is pure Ni.

17. A spark plug for internal combustion engines of claim 16, wherein, when taking a diameter of the noble metal chip (60) as D and taking a distance between the tip of the first core member (44) and the front end of the earth electrode (40) as L2, the tip of the first core member (44) is located in such a manner that the distance L2 is larger than the distance L0 in cases the diameter D is larger than 2.2 mm.

18. A spark plug for internal combustion engines of claim 1, wherein, when taking a diameter of the noble metal chip (60) as D and taking a distance between the tip of the first core member (44) and the front end of the earth electrode (40) as L2, the tip of the first core member (44) is located in such a manner that the distance L2 is larger than the distance L0 in cases the diameter D is larger than 2.2 mm.

19. A method for manufacturing a spark plug for internal combustion engines, which is provided with an earth electrode (40) having a front end facing to a center electrode (30) of the spark plug, a noble metal chip (60) being welded to the front end, the method comprising the steps of:

preparing a first cup-like element (200) made of a first metal having corrosion resistance and oxidation resistance, a second cup-like element (201) made of a second metal superior in heat conductivity than the first metal, and a core member (202) which is a rod-like member made of a third metal higher in melting point than the second metal and superior in heat conductivity than the first metal and which has a diameter-increased head portion (202*a*) formed at one end of the rod-like member and larger in diameter than the other end thereof;

forming a complex (203) in which the core member (202) and the second cup-like member (201) are united with the diameter-increased head portion (202*a*) exposed from the second cup-like member (201) by inserting the core member (202) into the second cup-like element (201) with the other end thereof ahead;

forming a member (204) in which the complex (203) and the first cup-like member (200) with the diameter-increased head portion (202*a*) located at a bottom of an opening of the first cup-like member (200) by inserting the complex (203) into an opening of the first cup-like member (200) with the diameter-increased head portion (202*a*) ahead; and shaping the united member (204) into the earth electrode (40) by extruding the united member (204) with the bottom of the opening of the first cup-like element (200) ahead.

20. A method for manufacturing a spark plug for internal combustion engines, which is provided with an earth electrode (40) having a front end facing to a center electrode (30) of the spark plug, a noble metal chip (60) being welded to the front end, the method comprising the steps of:

preparing a first cup-like element (200) made of a first metal having corrosion resistance and oxidation resistance, a rod-like element (300) formed by cladding, with a second metal superior in heat conductivity than the first metal, a third metal higher in melting point than the second metal and superior in heat conductivity than the first metal, and a disk-like element (301) made of the third metal locating the disk-like element (301) at a bottom of an opening of the cup-like element (200);

forming a member (304) in which the disk-like element (301) and the cup-like element (200) are united with the disk-like member sandwiched between an inserted tip of the rod-like element (300) and the bottom of the opening of the cup-like element (200) by inserting the rod-like element (300) into the cup-like element (200); and shaping the united member (304) into the earth electrode (40) by extruding the united member (304) with the bottom of the opening of the cup-like element (200) ahead.

* * * * *